US010240387B2

(12) United States Patent
Nelson

(10) Patent No.: US 10,240,387 B2
(45) Date of Patent: Mar. 26, 2019

(54) MODULAR FRAME FOR AN APPLIANCE STRUCTURE

(71) Applicant: Midea Group Co., Ltd., Beijiao (CN)

(72) Inventor: Nathan Nelson, Louisville, KY (US)

(73) Assignee: Midea Group Co., Ltd., Beijiao, Shunde, Foshan, Guangdong (CN)

( * ) Notice: Subject to any disclaimer, the term of this patent is extended or adjusted under 35 U.S.C. 154(b) by 10 days.

(21) Appl. No.: 15/465,284

(22) Filed: Mar. 21, 2017

(65) Prior Publication Data

US 2018/0274282 A1 Sep. 27, 2018

(51) Int. Cl.

| | |
|---|---|
| ***E06B 1/12*** | (2006.01) |
| ***E06B 1/52*** | (2006.01) |
| ***F24C 15/00*** | (2006.01) |
| ***E06B 1/60*** | (2006.01) |

(52) U.S. Cl.

CPC ..... *E06B 1/60* (2013.01); *E06B 1/12* (2013.01); *E06B 1/52* (2013.01); *F24C 15/00* (2013.01)

(58) Field of Classification Search

CPC ..... E06B 1/60; E06B 1/12; E06B 1/52
USPC ..... 126/273 R, 50
See application file for complete search history.

(56) References Cited

U.S. PATENT DOCUMENTS

| | | | | |
|---|---|---|---|---|
| 3,786,738 | A * | 1/1974 | Fahre | F24F 13/08 454/320 |
| 4,051,837 | A * | 10/1977 | Norman | F24B 1/003 126/275 R |
| 4,515,146 | A | 5/1985 | Wilkening | |
| 4,922,659 | A | 5/1990 | Muccioli | |
| 4,935,593 | A | 6/1990 | Nishikawa | |
| 5,172,628 | A * | 12/1992 | Pillsbury | A47J 37/0745 99/419 |
| 5,461,510 | A * | 10/1995 | Vilnes | G09F 9/00 348/840 |
| 6,365,836 | B1 * | 4/2002 | Blouin | H01B 11/04 174/113 C |
| 6,530,183 | B1 | 11/2003 | Kuei-Yung | |
| 7,146,769 | B1 * | 12/2006 | Culverson | E06B 1/702 52/204.5 |
| 7,229,000 | B2 * | 6/2007 | Wang | B23K 1/085 228/47.1 |

(Continued)

FOREIGN PATENT DOCUMENTS

| | | | |
|---|---|---|---|
| CN | 101737816 | A | 6/2010 |
| CN | 202092194 | U | 12/2011 |

(Continued)

OTHER PUBLICATIONS

Frigidaire Trim Kit for 26" Through-the-Wall Air Conditioners & Reviews, www.wayfair.com, Nov. 11, 2016.

(Continued)

*Primary Examiner* — Gregory L Huson
*Assistant Examiner* — Nikhil P Mashruwala
(74) *Attorney, Agent, or Firm* — Middleton Reutlinger

(57) ABSTRACT

An adjustable modular frame for a cooking appliance. The modular frame may be a front frame structure having a plurality of members or sections. The front frame may include an upper front frame section and a lower front frame section connected by a pair of front frame sections to define an outer periphery for a cavity opening. The dimensions and/or shape of the front frame structure may be adjusted to be used in a variety of applications.

9 Claims, 5 Drawing Sheets

(56) References Cited

U.S. PATENT DOCUMENTS

| | | | | |
|---|---|---|---|---|
| 7,789,081 | B2 | 9/2010 | Raby et al. | |
| 2005/0133016 | A1* | 6/2005 | Neal | A21B 1/24 126/19 R |
| 2010/0269889 | A1* | 10/2010 | Reinhold | F24S 25/12 136/251 |
| 2014/0326794 | A1* | 11/2014 | Frank | F24F 11/0012 236/49.3 |
| 2015/0027429 | A1 | 1/2015 | Nelson et al. | |
| 2018/0317650 | A1* | 11/2018 | Bova | A47B 47/027 |

FOREIGN PATENT DOCUMENTS

| | | | |
|---|---|---|---|
| CN | 202647928 | U | 1/2013 |
| CN | 205546227 | U | 8/2016 |
| DE | 2542308 | A1 | 3/1977 |
| DE | 3537121 | A1 | 4/1987 |
| GB | 2100978 | B | 10/1984 |
| JP | S61161343 | A | 9/1986 |
| JP | 2014054466 | A2 | 3/2014 |

OTHER PUBLICATIONS

International Search Report and Written Opinion issued in Application No. PCT/CN2017/101431 dated Dec. 20, 2017.

* cited by examiner

MODULAR FRAME FOR AN APPLIANCE STRUCTURE

BACKGROUND

The present embodiments relate to a modular frame integrated into an appliance, and particularly, but not limited to, for a gas and/or electric oven appliance.

As shown in FIG. 1, a typical oven front frame structure 1 requires individualized tooling for a specific model creating a full single piece structure. Each full single piece front frame structure 1 defines the full cavity opening 2 of the cooking compartment 3 for a specific model, for example having a particular height and width. If a different cavity opening size is required, another entire die set would be created to the appropriate dimensions. As a result, the tooling die set is preset for a particular configuration and may not, for example, be adjusted subsequently to one or more different applications or configurations. This practice reduces the speed of delivering model changes to the market, does not readily accommodate variations, requires a large investment for tooling, increases material waste, and increases retooling costs. Thus, there is a need to streamline manufacture while reducing cost, material waste, and production time.

SUMMARY

In some embodiments, a method of manufacturing a cooking appliance may comprise the step of providing a first cooking compartment. In various embodiments, the method may include providing a first pair of vertical front frame sections. In addition, in some embodiments, the method may include providing an upper front frame section. In various embodiments, the method may include providing a lower front frame section. Moreover, in some embodiments, the method may include assembling the upper front frame section, the lower front frame section, and the first pair of vertical front frame sections to create a first outer periphery defining a first cavity opening for the first cooking compartment. In various embodiments, the method may include coupling the first outer periphery defining the first cavity opening with the first cooking compartment.

In addition, in some embodiments, the method may include coating the first outer periphery. In various embodiments, the method may include assembling a second outer periphery having the upper front frame section, the lower front frame section, and a second pair of vertical front frame sections and coupling to the first outer periphery. Moreover, in some embodiments, the first cavity opening defined by the first outer periphery may be different from a second cavity opening defined by the second outer periphery. In various embodiments, each one of the first pair of vertical front frame sections may include a first length and each one of the second pair of vertical front frame sections may include a second length, wherein the second length may be longer than the first length. In some embodiments, the step of assembling the upper front frame section, the lower front frame section, and the pair of vertical front frame sections may include welding the upper front frame section, the lower front frame section, and the pair of vertical front frame sections to each other. In addition, in various embodiments, each one of the pair of vertical front frame sections may include a first length that may be shorter than an interior vertical distance of the first cavity opening.

In some embodiments, a method of manufacturing a cooking appliance may comprise the step of determining an interior horizontal distance of a front frame structure by selecting an upper front frame section and a lower front frame section. In various embodiments, the method may include determining an interior vertical distance of the front frame structure by selecting a pair of vertical front frame sections having a first length. In addition, in some embodiments, the method may include assembling the upper front frame section and the lower front frame section with the pair of vertical front frame sections to define an outer periphery of the front frame structure to a first cooking compartment.

In addition, in some embodiments, the method may include a first cooking compartment, and the step of coupling the front frame structure to the first cooking compartment. In various embodiments, the method may include coating the front frame structure. Moreover, in some embodiments, the method may include providing a plurality of vertical front frame sections, wherein the pair of vertical front frame sections may have the first length and another pair of vertical front frame sections may have a second length, wherein the first length may be different from the second length. In some embodiments, the step of assembling may further include welding the pair of vertical front frame sections to the upper front frame section and the lower front frame section. In various embodiments, the method may include coupling the front frame structure to a rear frame structure and a base structure. Moreover, in some embodiments, the first length of the pair of vertical front frame sections may be less than the interior vertical distance of the front frame structure. In some embodiments, the method may include manufacturing the pair of vertical front frame sections, the upper front frame section, and the lower front frame section using at least one of stamped or fabricated sheet metal.

Further, in some embodiments, an adjustable front frame structure for a cooking appliance may include an upper front frame section that has an inverted U-shape, wherein the upper front frame section may include a first end and an opposing second end. In various embodiments, the front frame structure may include a lower front frame section that has a U-shape, wherein the lower front frame section may include a first end and an opposing second end. Moreover, in some embodiments, the front frame structure may include a first vertical front frame section and a second vertical front frame section, wherein each of the first vertical front frame section and the second vertical front frame section may include a first end an a second end. In addition, in various embodiments, each of the first vertical front frame section and the second vertical front frame section may include a first length. In some embodiments, the first end of the first vertical front frame section may engage the first end of the upper front frame section and the second end of the first vertical front frame section may engage the first end of the lower front frame section and wherein the first end of the second vertical front frame section may engage the second end of the upper front frame section and the second end of the second vertical front frame section may engage the second end of the lower front frame section. Further, in some embodiments, the first length of the first vertical front frame section and the second vertical front frame section may define a desired vertical distance between the upper front frame section and the lower front frame section.

In addition, in some embodiments, the first vertical front frame section and the second vertical front frame section may be welded to the upper front frame section and the lower front frame section. In various embodiments, the front frame structure may include a porcelain enamel coating. In some embodiments, the front frame structure may be in combination with a cooking compartment. Moreover, in various embodiments, the first end and the second end of at least one of the first vertical front frame section and the second vertical front frame section may include a protrusion received within a corresponding receptacle of at least one of the first end of both the upper front frame section and lower front frame section or the second end of both the upper front frame section and lower front frame section.

These and other advantages and features, which characterize the embodiments, are set forth in the claims annexed hereto and form a further part hereof. However, for a better understanding of the embodiments, and of the advantages and objectives attained through its use, reference should be made to the Drawings and to the accompanying descriptive matter, in which there is described example embodiments. This summary is merely provided to introduce a selection of concepts that are further described below in the detailed description, and is not intended to identify key or essential features of the claimed subject matter, nor is it intended to be used as an aid in limiting the scope of the claimed subject matter.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

Figure 1:
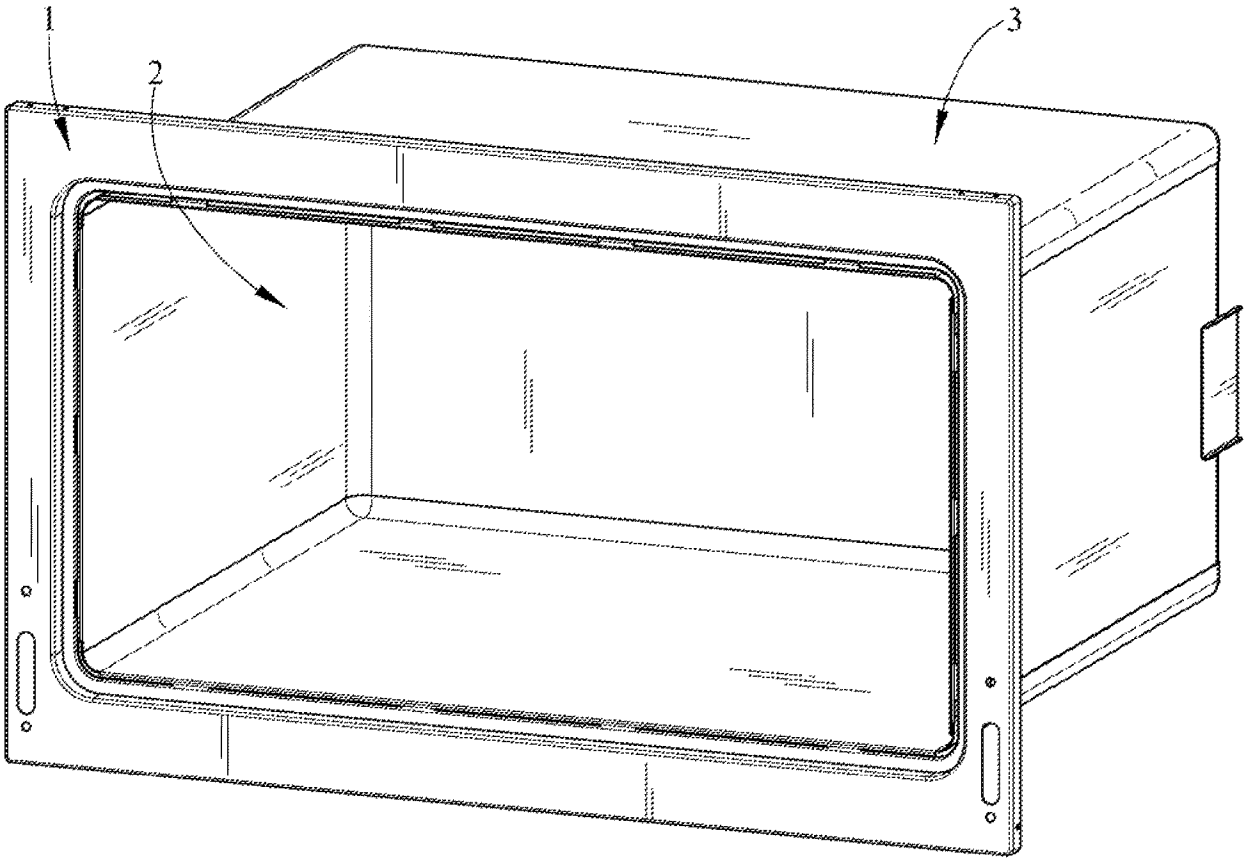
Prior Art FIG. 1
FIG. 1 is a perspective view of a single piece front frame structure of the prior art.

Numerous variations and modifications will be apparent to one of ordinary skill in the art, as will become apparent from the description below. Therefore, the invention is not limited to the specific implementations discussed herein.

In FIGS. 2-5, an adjustable front frame structure or support structure 20 may be segmented for a variety of applications. The front frame structure 20 may allow for shared tooling to allow one or more segments or sections to be used between several applications or embodiments. For example, common upper and lower front frame sections 30, 40 may be used for multiple different height cavities and/or cooking compartments 90. In various embodiments, one or more front frame structures 20 may be used in a cooking appliance 10. In the one embodiment shown in FIG. 5, a dual oven appliance 10 embodiment uses two different embodiments (e.g. a stacked front frame structure for one dual oven embodiment) of the front frame structure 20, 120. However, the two front frame structures may be similar (e.g. the upper and lower cooking compartments are similar) within an appliance embodiment. Although not shown, it should be understood that an embodiment of the cooking appliance 10 may use a single front frame structure.

As illustrated in FIGS. 2-5, the front frame structure 20 may include several segments or sections creating an outer periphery 22 that defines at least partially an opening or cavity opening 24 therethrough into at least one cooking compartment 90. In the one embodiment shown, the front frame structure 20 may include the upper front frame section 30, a lower front frame section 40, and at least a pair of substantially vertical or connecting front frame sections or sides 50 (e.g. first vertical front frame section 51 and second vertical front frame section 52). The pair of vertical front frame sections 50 couple the upper front frame section 30 with the lower front frame section 40. It is understood that the front frame structure may be a variety of sizes, shapes, construction, and quantities and still be within the scope of the teachings herein.

As shown in FIGS. 2-5, the upper front frame section 30 may have an inverted U-shape in some embodiments. The upper front frame section 30 may have a first end 30*a* and an opposing second end 30*b*. The first end 30*a* and second end 30*b* may extend downwardly towards the lower front frame section 40. In some embodiments the first end 30*a* and/or second end 30*b* may include a receptacle 32 to receive an upper portion or first end 50*a* of the respective pair of vertical front frame sections 50. The upper front frame section 30 may define the upper corners 34 of the cavity opening 24 in some embodiments. In the one embodiment shown, the upper front frame section 30 may have a top member 36 and opposing depending members 38. It is understood that the upper front frame section may be a variety of sizes, shapes, construction, and quantities and still be within the scope of the teachings herein.

As shown in FIGS. 2-5, the lower front frame section 40 may have a U-shape in some embodiments. The lower front frame section 40 may have a first end 40*a* and an opposing second end 40*b*. The first end 40*a* and second end 40*b* may extend upwardly towards the upper front frame section 30. In some embodiments the first end 40*a* and/or second end 40*b* may include a receptacle 42 to receive a lower portion or second end 50*b* of the respective pair of vertical front frame sections 50. The lower front frame section 40 may define the lower corners 44 of the cavity opening 24 in some embodiments. In various embodiments, the lower front frame section 40 may include one or more hinge openings 43 or other structure to accommodate the corresponding front door 16. In the one embodiment shown, the lower front frame section 40 may have a bottom member 46 and opposing upwardly projecting members 48. In the one embodiment shown, the corners 34, 44 being defined by the corresponding upper and/or lower front frame section 30, 40 may provide for rigidity that may but is not limited to shipping loads. However, it should be understood that that corners may be defined by a variety of structure including but not limited to the vertical front frame sections alone or combined with the upper and/or lower front frame section. It is understood that the lower front frame section may be a variety of sizes, shapes, construction, and quantities and still be within the scope of the teachings herein.

As illustrated in FIGS. 2-5, the vertical front frame sections 50 (e.g. first vertical front frame section 51 and/or second vertical front frame section 52) may couple the upper front frame section 30 and the lower front frame section 40. The vertical front frame sections 50 may couple to a respective end or portion of each of the upper front frame section 30 and lower front frame section 40. In the one embodiment shown, the elongated vertical front frame sections 50 include the upper or first end 50*a* and an opposing lower or second end 50*b*. In some embodiments, the first end 50*a* and/or second end 50*b* may include a protrusion 53. The protrusion 53 of the vertical front frame sections 50 may couple to or be received by the corresponding receptacle 32 of the upper front frame section 30 and/or lower front frame section 40. In the one embodiment shown, the protrusion 53 slides into the corresponding receptacle 32 until reaching an abutment or larger portion 54 of the vertical front frame sections 50. It is understood that the vertical front frame sections may be a variety of sizes, shapes, construction, and quantities and still be within the scope of the teachings herein. For example, the vertical front frame section or sides may be a variety of orientations and still connect the lower and upper front frame sections.

Figure 2:
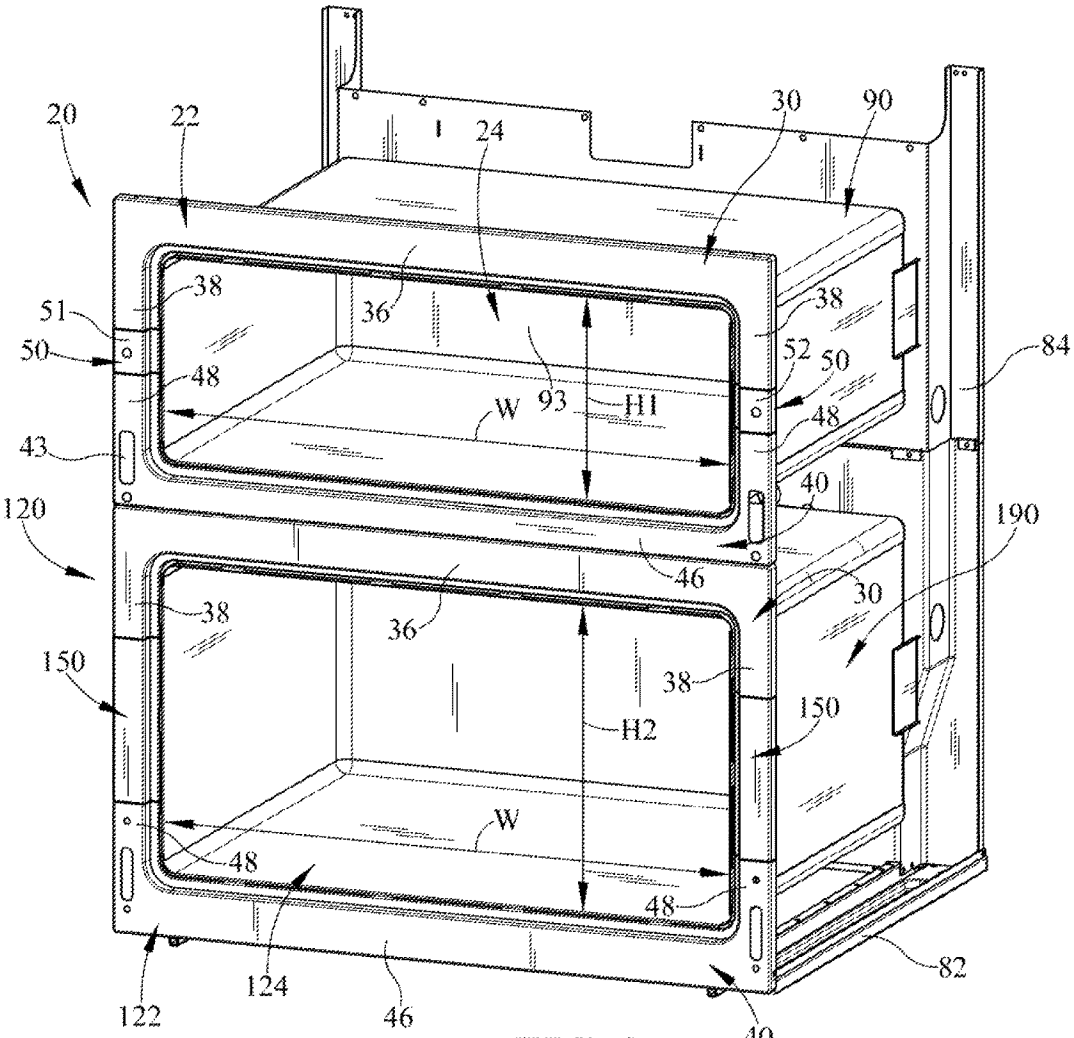
FIG. 2 is a perspective view of one embodiment of a front frame structure in combination with a second embodiment of a front frame structure, illustrating one embodiment of a cooking appliance support frame.
Figure 3:
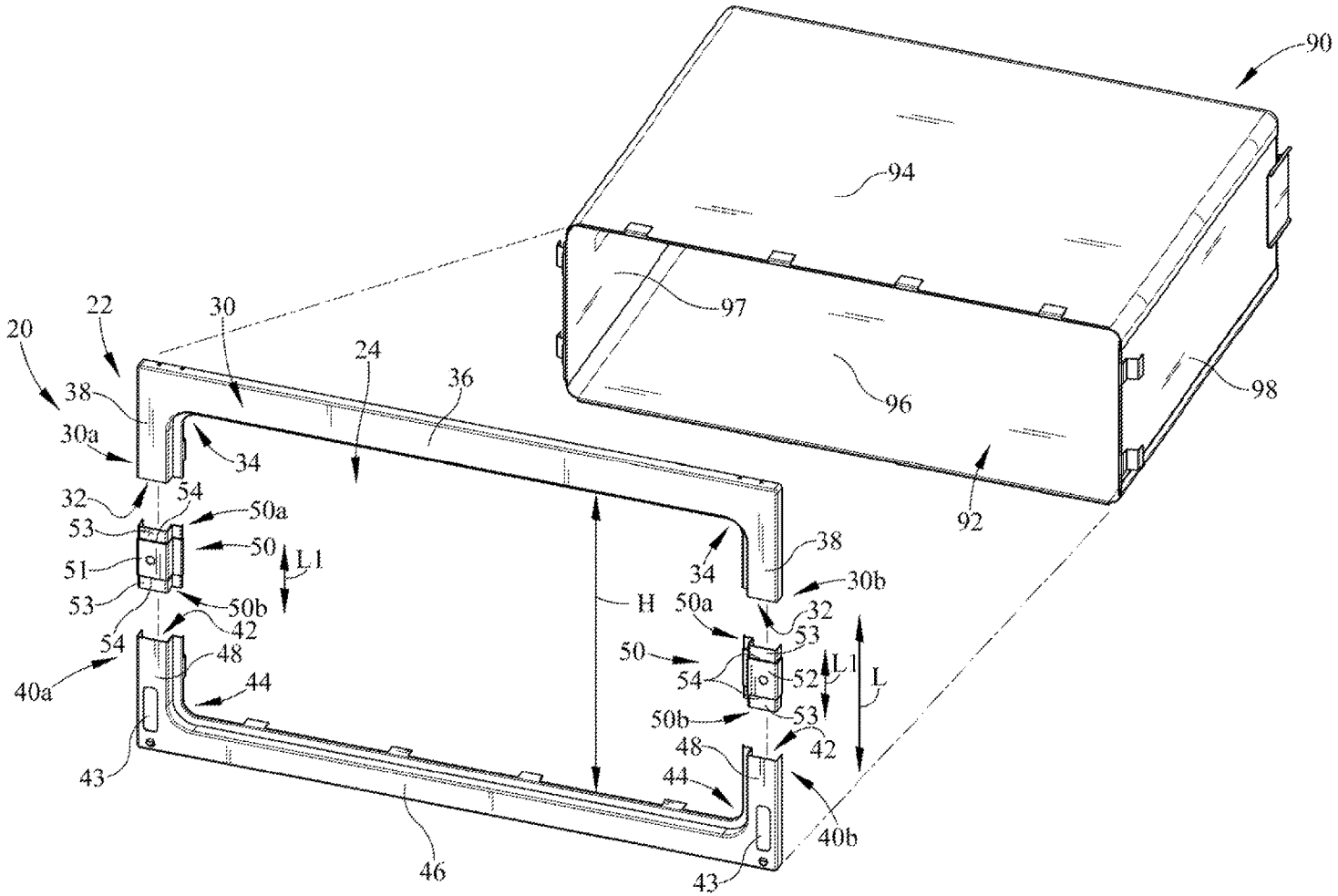
FIG. 3 is an exploded view of the first embodiment of the front frame structure and the first cooking compartment of FIG. 2.

In various embodiments, the front frame structure and/or sections may be adjustable to correspond to a desired application (e.g. quantity, dimensions, and/or shape). One or more common sections may be used to create a variety of cavity openings 24 and/or outer peripheries 22 for a variety of front frame structures and/or cooking compartments 90. In some embodiments, the height H and/or width W may be adjusted. For example, a variety of vertical front frame sections 50 having different lengths L may be changed or selected to accommodate a shorter or taller cavity size or dimension. Another example, a variety of the upper and lower front frame sections 30, 40 having different widths may be changed or selected to accommodate a wider or narrower cavity size or dimension by using common vertical front frame sections. In some embodiments, the length L of the first and second vertical front frame sections 51, 52 may determine the desired vertical distance and/or height between the upper front frame section 30 and the lower front frame section 40 to correspond to the desired outer periphery 22, interior vertical dimension/distance or height H of the cavity opening 24, and/or desired cooking compartment 90 (e.g. cooking compartment opening 92) for an application. As illustrated between the embodiments of the front frame structure 20 and 120 of FIGS. 2-4, the selected length L of the vertical front sections 50 may adjust the height H of the cavity opening 24 using the common upper and lower front frame section 30 and 40. A first length L1 of the pair of vertical front frame sections 50 of FIGS. 2 and 3 may be smaller than a second length L2 of the pair of vertical front frame sections 150 of FIGS. 2 and 4 resulting in a smaller or shorter cavity opening 24. The vertical front frame sections 50 of front frame structure 20 may have the first length L1 creating a first height H1 (FIG. 2). Further, the vertical front frame sections 150 of front frame structure 120 may have the second length L2 creating a second height H2 (FIG. 2) and/or cavity opening 124 defined by a different outer periphery 122. As a result, the first height H1 is smaller than the second height H2 while in some embodiments having a common width W. As is shown in the one embodiment, the first length L1 of the vertical front frame sections 50 do not have to be the total height H of the cavity opening 24. However, it should be understood that the length could be equal to and/or greater than the height H in some embodiments. In the one embodiment shown, a portion of each of the vertical front frame sections 50, upper front frame section 30, and lower front frame section 40 combine to create the height H of the cavity opening 24. For example in some embodiments, depending members 38 of upper front frame section 30, projecting members 48, and the portion of the vertical front frame section between the opposing protrusions 53 combine to create the desired or selected height H.

Figure 4:
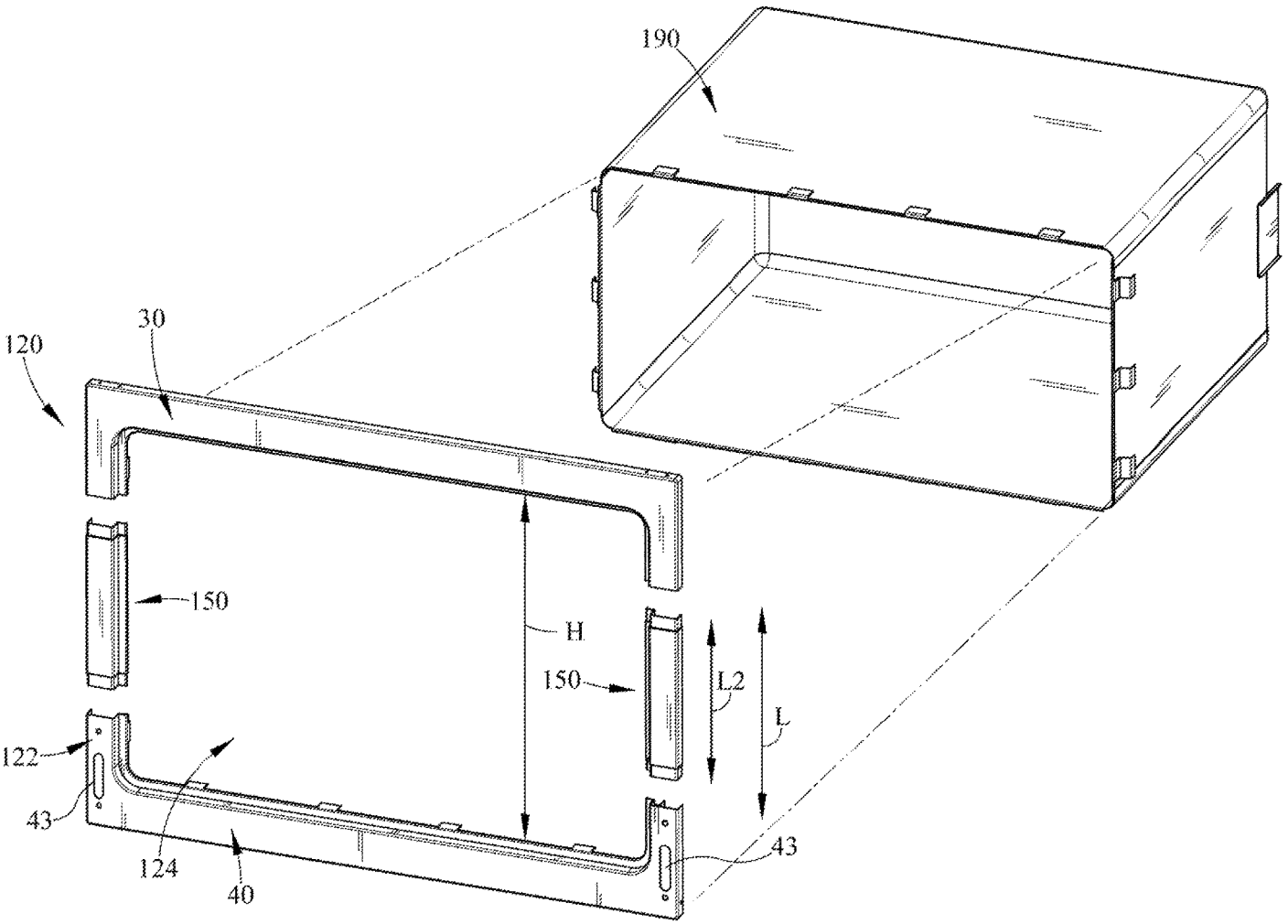
FIG. 4 is an exploded view of the second embodiment of the front frame structure and the second cooking compartment of FIG. 2.

In some embodiments, the front frame structure 20 may be combined with the cooking compartment 90. The front frame structure 20 may at least partially support the cooking compartment 90 and/or structure of the appliance 10. The cooking compartment opening 92 may be substantially aligned with the cavity opening 24 of the front frame structure 20 and the cooking compartment 90 projecting away therefrom. In some embodiments, the front frame structure 20 and the cooking compartment 90 may be coupled by a plurality of screws, fasteners, and/or tabs. The cooking compartment 90 may include a back wall 93, top wall 94, bottom wall 96, and opposing side walls 97, 98 in some embodiments. Another embodiment of a cooking compartment 190 is shown in FIGS. 2 and 4, wherein the cooking compartment 190 includes a larger height or dimension than the cooking compartment 90 in FIGS. 2, 3, and 5. As a result, the front frame structure 120 of FIGS. 2 and 4 may include or be adjusted with the vertical front frame sections 150 that are larger or longer than the vertical front frame sections 50 of FIGS. 2 and 3.

In some embodiments as more clearly shown in FIG. 2, the front frame structure 20 may be combined with at least one of the base structure 82 or the rear frame structure 84. The front frame structure 20, base structure 82, and/or rear frame structure 84 may support the one or more cooking compartments. The base structure 82 and/or one or more cooking compartments 90 may extend between the front frame structure 20 and the rear frame structure 84. In some embodiments, the front frame structure 20 may be coupled by a plurality of screws or fasteners to the rear frame structure 84 and/or the base structure 82. As shown in the FIGS. 2 and 5, two cooking compartments 90 and 190 are supported in one embodiment of the cooking appliance 10. It should be understood that one cooking compartment 90 may be supported and correspond to a single front frame structure 20 of one embodiment of the cooking appliance.

In use the front frame structure 20 may be manufactured and assembled for a particular application or cooking appliance 10. Each section of the front frame structure 20 may be made of a material such as but is not limited to cold rolled steel or enameling steel. Moreover, each segment or section may be stamped or fabricated sheet metal. A variety of die sets may be inserted and/or removed to create various features such as hinges, sensors, switches, latches, etc. With the desired cavity opening 24 and/or outer periphery 22 determined for a particular application or cooking compartment 90 (e.g. interior horizontal distance/width W and/or interior vertical distance/height H), the appropriate sections are selected to define the outer periphery 22 of the cavity opening 24. For example, the pair of vertical front frame sections 50 may have a desired or first length L1 to define the desired interior vertical distance or first height H1 of the cavity opening 24 and/or outer periphery 22 of the front frame structure 20. In various embodiments, the upper and lower front frame sections 30, 40 may be selected to define the desired interior horizontal distance for different width products such as 24, 27, and 30 inch products. Upon assembling the upper and lower front frame sections 30 and 40 with the vertical front frame sections 50, a variety of methods of joining may be used. Upon assembly in some embodiments, the front frame structure 20 may be fixed together by a variety of suitable methods known in the art such as but is not limited to welding or TOX joining. In some embodiments after welding or fixing the sections of the front frame structure 20, the front frame structure 20 or outer periphery 22 may be coated by a porcelain enamel or the like. Further, in some embodiments, the front frame structure 20 may be coupled to the cooking compartment 90, base structure 82, and/or rear frame structure 84. If used, as shown in the one embodiment, a second front frame structure 120 and corresponding cooking compartment 190 may be coupled to the first front frame structure 20.

Moreover, in some embodiments, assembling the upper and lower front frame sections 30 and 40 with the vertical front frame sections 50 may be accomplished in some embodiments by placing the sections within a fixture that may key off of one or more holes within one or more sections to properly position the parts. If used, the alignment or stamped holes of one or more sections may be fit tightly with the pins in the joining fixture. With the stamped sections held in position, the sections may be welded together in some embodiments. As a result, the position of the sections may be maintained to control variance in the joined assembly that may result in increased alignment with downstream assembly pieces such as doors, door liners, latches, etc.

Figure 5:
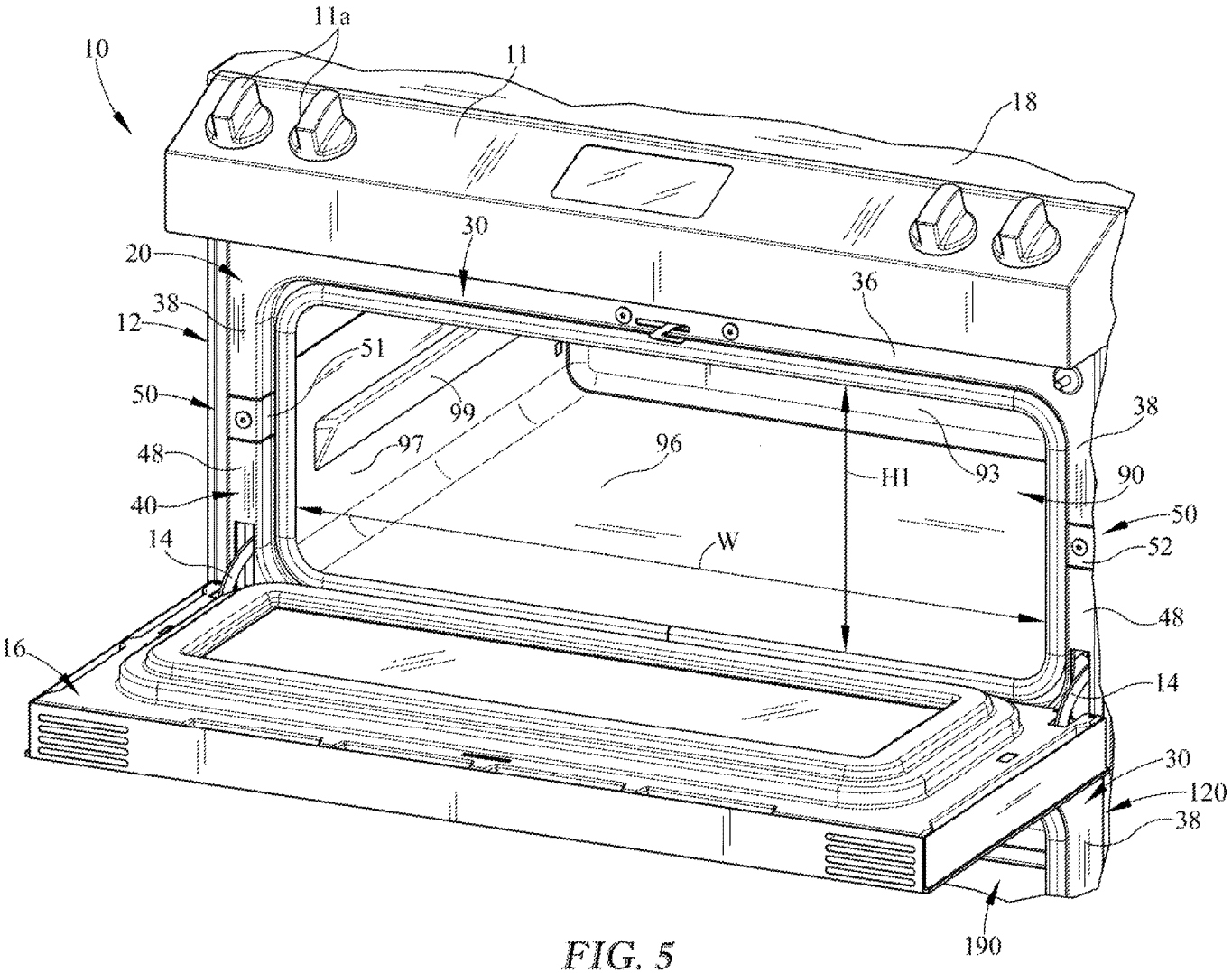
FIG. 5 is a perspective view of the first embodiment of the front frame of FIG. 2 within the cooking appliance, the oven front door is illustrated in the opened position and portions of the cooking appliance and second embodiment of the front frame removed.

As shown in the FIG. 5, the front frame structure 20 may be used in a home oven or cooking appliance 10, such as but not limited to a slide-in cooking range, having a housing 12 and the cooking compartment 90, such as a baking oven, convection oven, steam oven, warming drawer and the like, in the housing 12 and accessible through a front door or drawer 16 in the front of the housing 12. In the cooking appliance 10 shown in FIG. 5, the housing 12 may have a two cooking compartments 90 and 190 and their corresponding front frame structure 20 and 120. However, some embodiments may have a single compartment 90 and front frame structure 20. It should be understood that the one or more cooking compartments 90 and/or 190 may be heated by electric, hybrid of gas and electric, or combination of heat sources thereof. One application of an embodiment of the cooking appliance may be for a general purpose kitchen oven. The front door 16 and/or front frame structure 20 may at least partially define the cooking compartment opening 92 into the cooking compartment 90 and be positionable between an opened position (FIG. 5) and a closed position relative to the remainder of the front frame structure 20 and/or one or more of the walls or sides of the cooking compartment 90. The cooking appliance 10 may, for example, be a gas range. The cooking appliance 10 may include a cooktop surface 18 on a top of the housing 12. The cooking appliance 10 may further include a control panel 11 having a plurality of control knobs or controls 11*a* for controlling the gas burners, if a range used, and/or cooking compartment 90. In the embodiment shown, the front door 16 is hingedly connected, by one or more hinges 14, for opening to allow frontal access into the cooking compartment 90 through opening 92. As shown in one embodiment, the side walls 97, 98 may have rack supports 99 for grills or shelves.

While several embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings is/are used. Those skilled in the art will recognize, or be able to ascertain using no more than routine experimentation, many equivalents to the specific embodiments described herein. It is, therefore, to be understood that the foregoing embodiments are presented by way of example only and that, within the scope of the appended claims and equivalents thereto, embodiments may be practiced otherwise than as specifically described and claimed. Embodiments of the present disclosure are directed to each individual feature, system, article, material, and/or method described herein. In addition, any combination of two or more such features, systems, articles, materials, and/or methods, if such features, systems, articles, materials, and/or methods are not mutually inconsistent, is included within the scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of" or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

It is to be understood that the embodiments are not limited in its application to the details of construction and the arrangement of components set forth in the description or illustrated in the drawings. The invention is capable of other embodiments and of being practiced or of being carried out in various ways. Unless limited otherwise, the terms "connected," "coupled," "in communication with," and "mounted," and variations thereof herein are used broadly and encompass direct and indirect connections, couplings, and mountings. In addition, the terms "connected" and "coupled" and variations thereof are not restricted to physical or mechanical connections or couplings.

The foregoing description of several embodiments of the invention has been presented for purposes of illustration. It is not intended to be exhaustive or to limit the invention to the precise steps and/or forms disclosed, and obviously many modifications and variations are possible in light of the above teaching.

The invention claimed is:

1. A cooking appliance with an adjustable front frame comprising:

an adjustable front frame structure having an upper front frame section, a lower front frame section, a first vertical front frame section, and a second vertical front frame section;

a cooking compartment having a cooking compartment opening defined by a top wall, bottom wall, and opposing side walls, and wherein the cooking compartment adjacent the cooking compartment opening is supported by the adjustable front frame structure;

wherein the upper front frame section includes an inverted U-shape, wherein the upper front frame section includes a first end and an opposing second end;

wherein the lower front frame section includes a U-shape, wherein the lower front frame section includes a first end and an opposing second end;

wherein each of the first vertical front frame section and the second vertical front frame section includes a first end an a second end, wherein each of the first vertical front frame section and the second vertical front frame section includes a first length, wherein the first end of the first vertical front frame section engages the first end of the upper front frame section and the second end of the first vertical front frame section engages the first end of the lower front frame section and wherein the first end of the second vertical front frame section engages the second end of the upper front frame section and the second end of the second vertical front frame section engages the second end of the lower front frame section; and wherein the first length of the first vertical front frame section and the second vertical front frame section defines a desired vertical distance between the upper front frame section and the lower front frame section.

2. The cooking appliance of claim 1 wherein the first vertical front frame section and the second vertical front frame section are welded to the upper front frame section and the lower front frame section.

3. The cooking appliance of claim 1 wherein the adjustable front frame structure further comprises a porcelain enamel coating.

4. The cooking appliance of claim 1 wherein the first end and the second end of at least one of the first vertical front frame section and the second vertical front frame section includes a protrusion received within a corresponding receptacle of at least one of the first end of both the upper front frame section and lower front frame section or the second end of both the upper front frame section and lower front frame section.

5. A cooking appliance comprising:

a first cooking compartment having a plurality of sides defining a first cooking compartment opening;

a first front frame structure, a base structure, and a rear frame structure, wherein the first cooking compartment opening of the first cooking compartment is adjacent to and supported by the first front frame structure with the plurality of sides extending towards the rear frame structure;

wherein the first front frame structure includes an upper front frame section, a lower front frame section, and a pair of first vertical front frame sections;

wherein the upper front frame section includes an inverted U-shape, wherein the upper front frame section includes a first end and an opposing second end;

wherein the lower front frame section includes a U-shape, wherein the lower front frame section includes a first end and an opposing second end;

wherein each one of the pair of first vertical front frame sections includes a first end, a second end, and a first length between the first end and the second end, wherein the first end of the first vertical front frame section of the pair of first vertical front frame sections engages the first end of the upper front frame section and the second end of the first vertical front frame section of the pair of first vertical front frame sections engages the first end of the lower front frame section, and wherein the first end of the other first vertical front frame section of the pair of first vertical front frame sections engages the second end of the upper front frame section and the second end of the other first vertical front frame section of the pair of first vertical front frame sections engages the second end of the lower front frame section; and wherein the first length of each one of the first vertical front frame sections defines a desired vertical distance between the upper front frame section and the lower front frame section.

6. The cooking appliance of claim 5 further comprising a second cooking compartment having a plurality of sides defining a second cooking compartment opening;

a second front frame structure connected to the first front frame structure, wherein the second cooking compartment opening of the second cooking compartment is adjacent to and supported by the second front frame structure with the plurality of sides extending towards the rear frame structure;

wherein the second front frame structure includes an upper front frame section, a lower front frame section, and a pair of second vertical front frame sections;

wherein the upper front frame section includes an inverted U-shape, wherein the upper front frame section includes a first end and an opposing second end;

wherein the lower front frame section includes a U-shape, wherein the lower front frame section includes a first end and an opposing second end;

wherein each one of the pair of second vertical front frame sections includes a first end, a second end, and a second length between the first end and the second end, wherein the first end of the second vertical front frame section of the pair of second vertical front frame sections engages the first end of the upper front frame section and the second end of the second vertical front frame section of the pair of second vertical front frame sections engages the first end of the lower front frame section, and wherein the first end of the other second vertical front frame section of the pair of second vertical front frame sections engages the second end of the upper front frame section and the second end of the other second vertical front frame section of the pair of second vertical front frame sections engages the second end of the lower front frame section; and wherein the second length of each one of the second vertical front frame sections defines a desired vertical distance between the upper front frame section and the lower front frame section.

7. The cooking appliance of claim 6 wherein the first length is different than the second length.

8. The cooking appliance of claim 5 wherein the first length is shorter than an interior vertical distance of the first cooking compartment opening.

9. The cooking appliance of claim 5 wherein the first front frame structure is welded together.

* * * * *